US005740933A

United States Patent [19]

Conti et al.

[11] Patent Number: 5,740,933

[45] Date of Patent: *Apr. 21, 1998

[54] CHILD PROOF CONTAINER CAP DESIGNED FOR MANIPULATION BY ARTHRITIC FINGERS

[75] Inventors: Vincent N. Conti, West Hempstead, N.Y.; Don Yeager, Forest City, N.C.

[73] Assignee: American Safety Closure Corp., West Hempstead, N.Y.

[ * ] Notice: The term of this patent shall not extend beyond the expiration date of Pat. No. 5,423,441.

[21] Appl. No.: 291,521

[22] Filed: Aug. 15, 1994

Related U.S. Application Data

[63] Continuation-in-part of Ser. No. 169,066, Dec. 20, 1993, Pat. No. 5,423,441.

[51] Int. Cl.[6] ..... B65D 50/02; B65D 41/48

[52] U.S. Cl. ..... 215/256; 215/43; 215/46; 215/224; 215/295

[58] Field of Search ..... 215/253, 256, 215/230, DIG. 1, 44, 224, 225, 254, 258, 295, 305, 40, 43, 45, 46

[56] References Cited

U.S. PATENT DOCUMENTS

| | | | |
|---|---|---|---|
| 3,703,974 | 11/1972 | Boxer et al. | 215/217 |
| 3,881,622 | 5/1975 | Dockery | 215/44 |
| 3,991,904 | 11/1976 | Davis et al. | 220/334 |
| 4,071,156 | 1/1978 | Lowe | 215/224 |
| 4,071,943 | 2/1978 | Urbani | 215/295 X |
| 4,280,632 | 7/1981 | Yuhara | 215/331 |
| 4,342,400 | 8/1982 | Llera | 215/256 |
| 4,417,666 | 11/1983 | Roberts | 215/256 |
| 4,449,639 | 5/1984 | Davis | 215/224 |
| 4,511,051 | 4/1985 | Desai | 215/225 |
| 4,524,876 | 6/1985 | Kusz | 215/224 |
| 4,573,599 | 3/1986 | Fillmore | 215/225 |
| 4,591,063 | 5/1986 | Geiger | 215/331 X |
| 4,592,884 | 6/1986 | Thomson | 215/43 X |
| 4,646,926 | 3/1987 | Agbay et al. | 215/230 X |
| 4,658,977 | 4/1987 | Crisci | 215/DIG. 1 X |
| 4,676,389 | 6/1987 | Bullock | 215/43 X |
| 4,687,113 | 8/1987 | Reeve | 215/230 |
| 4,770,309 | 9/1988 | Thompson | 215/DIG. 1 X |
| 4,811,857 | 3/1989 | Thompson | 215/DIG. 1 X |
| 4,832,220 | 5/1989 | Quennessen | 215/331 |
| 4,919,286 | 4/1990 | Agbay, Sr. | 215/235 |
| 5,097,974 | 3/1992 | Rozenberg | 215/225 |
| 5,143,235 | 9/1992 | Repp | 215/256 |
| 5,158,194 | 10/1992 | Sirgo et al. | 215/305 X |
| 5,213,225 | 5/1993 | King et al. | 215/331 X |
| 5,351,845 | 10/1994 | Hunter | 215/230 X |
| 5,358,129 | 10/1994 | Watts | 215/305 X |
| 5,366,774 | 11/1994 | Pinto et al. | 215/44 X |
| 5,423,441 | 6/1995 | Conti | 215/225 |

*Primary Examiner*—Stephen P. Garbe
*Assistant Examiner*—Robin Hylton
*Attorney, Agent, or Firm*—Nolte, Nolte and Hunter, P.C.

[57] ABSTRACT

A tamper indicating, child proof, container cap designed for easy manipulation by arthritic fingers of a user includes an annular tear strip and a rotatably indexing latch finger on the cap which engages a raised annular retainer ridge with bypass opening on the neck of the container. A tactile indicator of the rotational location of the bypass opening is under the tear strip for sensing by the user's finger that is in simultaneous contact with the cap when the tear strip is removed. A lower ridge includes an index key for orienting the latch finger away from the bypass opening during assembly of the system. The top of the cap includes an extended axial length portion that is shaped for easy grip by arthritic fingers.

1 Claim, 3 Drawing Sheets

CHILD PROOF CONTAINER CAP DESIGNED FOR MANIPULATION BY ARTHRITIC FINGERS

This is a continuation-in-part of application Ser. No. 08/169,066, filed Dec. 20, 1993, now U.S. Pat. No. 5,423,441.

BACKGROUND OF THE INVENTION

1. Field of the Invention

This invention relates to closures for containers, more specifically to a tamper indicating, child proof, reusable snap-off cap and container, closure system. The invention also relates to such a snap-off cap constructed for facile manipulation by persons having arthritic or otherwise enfeebled hands.

2. Description of the Prior Art

The container closure art is replete with tamper-indicating, child proof designs including caps with frangible elements connecting the cap to the container, and with spring loaded bayonet locking means, spring loaded ratchet means, and other arrangements which make it difficult for a child to open the container once the frangible element is breached.

U.S. Pat. No. 4,449,638, patented May 22, 1984 by E. Davis describes a tamper indicating, child proof design of a container having a cylindrical neck with open top mouth. The mouth opening also continues through a portion of the neck in a vertical finger width slot.

A cap with a rotatable plug and a lower skirt is pressed over the neck, whereby the skirt engages annular raised ridges on the neck of the cap preventing subsequent removal of the skirt from the neck. The plug extends into and seals the open top mouth.

An annular tear band joins the upper portion of the cap with the skirt, and also is attached by telltale bridge members to the plug. Tearing away the band separates the top of the cap from the skirt, and breaks the bridge members to further indicate the initial breach of the closure.

The plug has a radially oriented finger hole which must be accessed by way of the finger width slot, in order to be able to apply upward pressure to the plug by a finger to remove it with the cap top from the container. The upward finger pressure can only be applied to the plug from within the plug.

The top of the plug includes an arrow to help the user rotate the plug finger hole into alignment with the slot.

U.S. Pat. No. 4,449,639, patented by E. Davis, on May 22, 1984, describes a tamper-indicating, child-resistant closure with a cap having a top part, a tear band in the middle, and a captive band at the bottom, cooperating with the neck of the container.

In assembly, the cap is forced onto the neck until a pair of annular parallel raised ridges in the inside of the captive band pass a corresponding pair of annular parallel raised ridges on the outside of the container neck, thereby irreversibly retaining the captive band on the neck.

The top part of the cap has an arcuate internal lug to engage below an arcuate external projection on the rim of the container neck to keep the cap on the container after the tear band is removed by pulling on a pull tab. The cap then cannot be removed until it is rotated so that the lug disengages from the projection to free the cap for removal from the neck. Indication is given for rotation of the cap to the disengagement position, for example, by an upward pointing arrow on the outer surface of the container, and a serrated grip tab by which the cap is lifted, shaped into a downward pointing arrow.

To breach the closure and to open the container, the user tears away the band. Frangible bridge members attached variously to the cap top, tear band, pull tab, and captive band, provide indication of tampering by breaking when the tear band is removed.

The user then lines up the two arrows to bring the cap into position for removal, and urges the cap up and off the container by way of a serrated grip tab.

SUMMARY OF THE INVENTION

Objects of the present invention include providing a child proof, tamper indicating closure that can be operated by a person without need for glasses and with minimum manual dexterity.

Accordingly, it is one object of the invention to provide a closure with an unobstructed finger grip area for applying pressure to urge the cap away from the opening.

It is another object of the invention to provide a closure with a tear strip to persuade against tampering, and to provide clear indication of breach of the closure.

Another object is to provide a closure that is child proof by requiring rotating of the cap to a predetermined position in order to be able to remove the cap.

It is a particular object of the invention to provide such a closure in which the cap is formed for facile rotation by a person with arthritic or otherwise enfeebled hands.

Another object is that indication be provided on the container and cap of the predetermined position to be attained.

Another object is that tactile indication of the predetermined position be provided in a closure that is child proof and tamper indicating, for sensing by the finger that is operating the finger grip area, as the finger is rotating the cap to the predetermined position.

Another object is to provide a combination visual, tactile, and assembly, index means on the container to help the user locate the predetermined position, and to help in assembly to index the cap and container so that the cap will not by happenstance be in the predetermined position when the tear strip is removed. This further enhances the child proof feature of the invention.

Another object is to provide a seal of the container by the closure cap that has reduced resistance to rotation of the cap.

Other objects and advantages will become readily apparent to one reading the ensuing detailed description of the invention.

The closure system container neck includes, in order from the opening in the neck, first, second and third annular raised retainer ridges which are generally parallel and spaced from one another. The system cap includes an annular inner wall, and depending from the periphery of the wall, an annular skirt having a first end comprising the periphery of the inner wall.

On an inner side of the skirt, in order from the first end, first, second, and third annular raised anchor ridges for bearing respectively against the first, second and third retainer ridges on their distal sides with respect to the opening when the cap is fully seated on the neck over the opening.

First and second separation bands of reduced thickness of the skirt are located respectively between the first and second anchor ridges, and between the second and third anchor ridges.

A tear strip annular portion of the skirt between the first and second bands, when removed by means for pulling it, frees the cap from the remainder of the skirt distal from the first band so that the cap is independent from the container when the cap is removed from the neck.

The first anchor ridge is discontinuous and has in series a single narrow latch finger extending generally normally from the inner side of the skirt. A narrow portion of the first retainer ridge is of reduced height forming thereby, a latch finger bypass opening through which the latch finger can pass for initiating removal of the cap from the neck.

Preferably, no other raised portion of the first anchor ridge is narrower than the bypass opening.

Finger grip means is provided for urging the cap away from the opening.

The closure system also includes, generally under the tear strip, means, within the inclusive region from the second retainer ridge to the third retainer ridge, for tactile indication by a finger of an operator of the rotational location of the bypass opening by rotation of said cap while the finger is simultaneously in contact with the finger grip means.

On a fourth annular raised ridge on the outer surface of the neck, the fourth ridge being spaced from the third retainer ridge distally from the opening, is an index key in predetermined location with respect to the latch finger bypass. The index key comprises a narrow portion of the fourth ridge having a change in shape with respect to the general shape of the remainder of the ridge. Preferably, the change in shape extends in a raised portion of the neck generally normal to the fourth ridge.

In an important modification to the invention is an arthritic-grip-friendly top of the cap in which the cap portion of the closure system is constructed with an extended height and circumferentially spaced grasping surfaces. In a preferred embodiment, the outer circumference of the cap portion is octagonal in form with circumferentially disposed flat grasping surface separated by grasping ridges. It is important to provide the cap portion with extra height so that a normally clumsy grasp by an enfeebled hand such as one with arthritic fingers will be able to turn and hold the cap. In this respect, it has been determined, by way of example, that the height of the cap should be approximately 0.500 inch given a cap diameter of 1.57 inches.

BRIEF DESCRIPTION OF THE DRAWINGS

In order that the invention be more fully comprehended, it will now be described, by the way of example, with reference to the accompanying drawings, in which.

DESCRIPTION OF THE PREFERRED EMBODIMENTS

Figure 1:
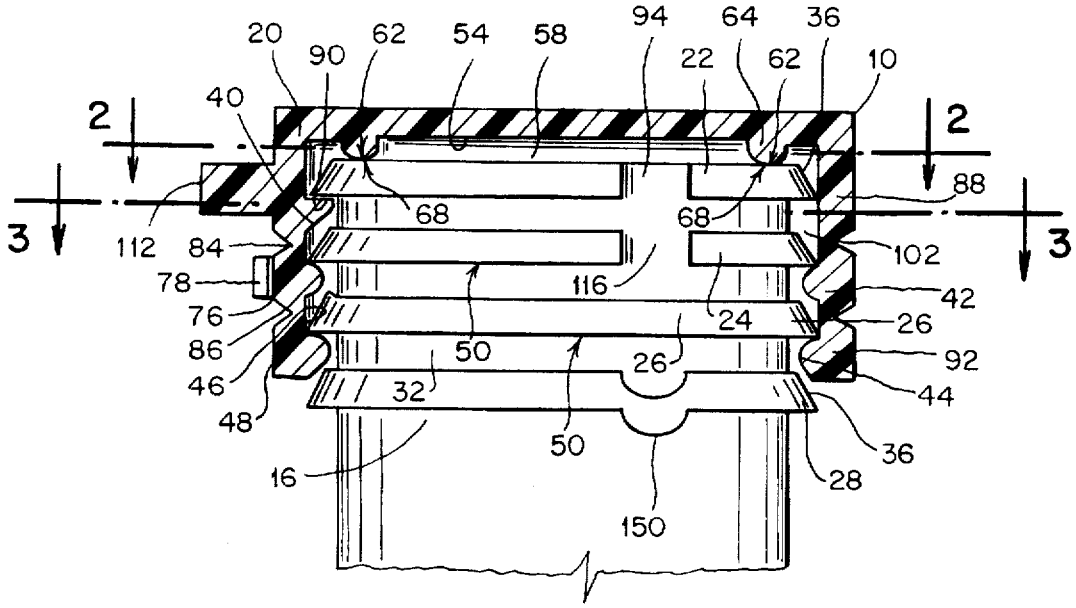
FIG. 1 is a front view of a closure system constructed according to the present invention. The cap portion is in cross sectional view.

Before explaining the invention in detail, it is to be understood that the invention is not limited in its application to the detail of construction and arrangement of parts illustrated in the drawings since the invention is capable of other embodiments and of being practiced or carried out in various ways. It is also to be understood that the phraseology or terminology employed is for the purpose of description only and not of limitation.

Referring to the drawings, FIG. 1 shows a closure system 10, on the upper portion 12 of a container body (not shown). The closure system comprises elements on neck portion 16 of upper body portion 12, in cooperation with cap 20. Neck 16 may be cylindrical, conical or take any generally circular form when considered in cross section.

Figure 2:
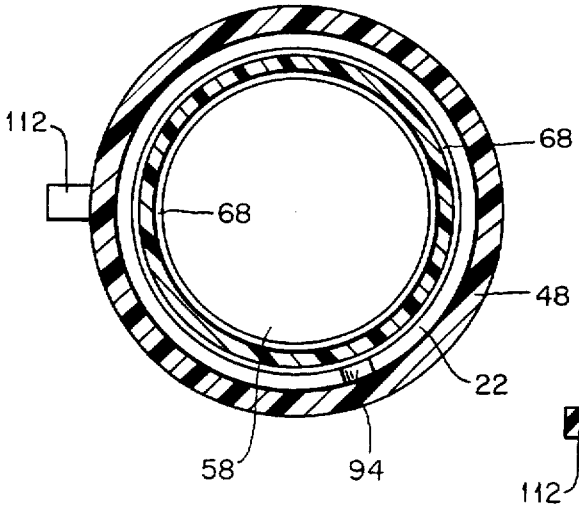
FIG. 2 is a top sectional view of the closure system shown in FIG. 1, taken along lines 2—2.
Figure 3:
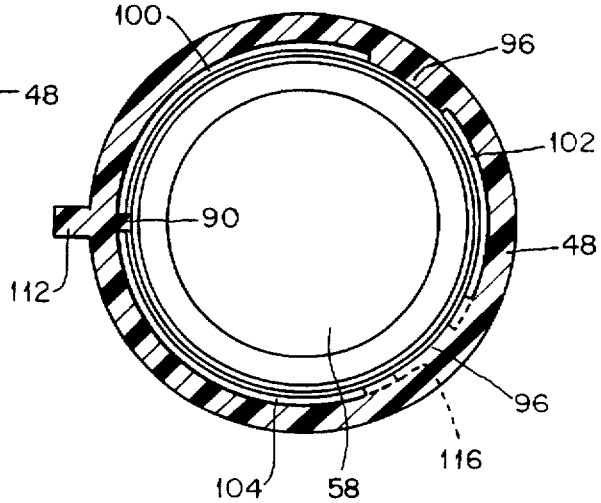
FIG. 3 is a top sectional view of the closure system shown in FIG. 1, taken along lines 3—3.
Figure 4:
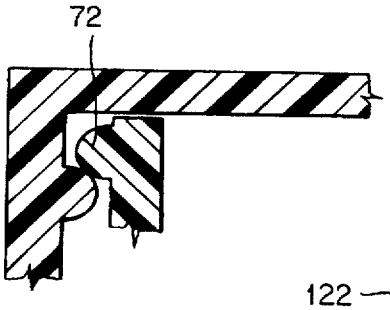
FIG. 4 is a sectional view of a portion of another closure system according to the invention.

Referring to FIGS. 1, 2, and 3, neck 16 includes annular raised retainer ridges 22, 24, 28, on the outer surface 32 of neck 16. The upper leading edges 36 of the retainer ridges are preferably angled down and out as the straight angle shown in FIG. 1 or curved out and down, as is retainer ridge 72 shown in FIG. 4.

Angled or curved leading edge 36 eases initial assembly of the cap on neck 16. As it is forced down over the neck, anchor ridges 40, 42, and 44 on the inner side 46 of skirt 48 must slip over the outer diameters of the retainer ridges, and snap-in below retainer surfaces 50, thus locking the cap on the neck.

The raised retainer and anchor ridges are preferably, but not necessarily, molded on the surfaces from which they rise. Ridges 22, 24, and 26 are generally parallel with one another.

Annular inner wall 54 seals container opening 58 by way of cap sealing surface 62 of annular seal ring 64 bearing upon opening sealing surface 68 of neck.

Annular seal ring 64 preferably contacts with annular sealing surface 68 only in a narrow band which is set back from, and does not include, the outer surface of the neck. This provides an effective seal normal to the opening sealing surface, without incurring additional frictional resistance to rotation from contact with adjacent surfaces.

When it is desired to unseal the closure system, annular tear strip 76 is pulled by tab 78 out of skirt 48 by tearing the strip along bands of reduced thickness 84 and 86. This separates tear strip 76 from annular rings 88 and 92.

After strip 76 is removed, ring 92 remains on neck 16, between annular raised retainer ridges 26 and 28.

Only annular anchor ridge 40, rising from inner side 46 of the skirt, and engaging retainer surface 50 of annular raised retainer ridge 22, keeps cap 20 from being lifted away from the container opening.

Figure 5:
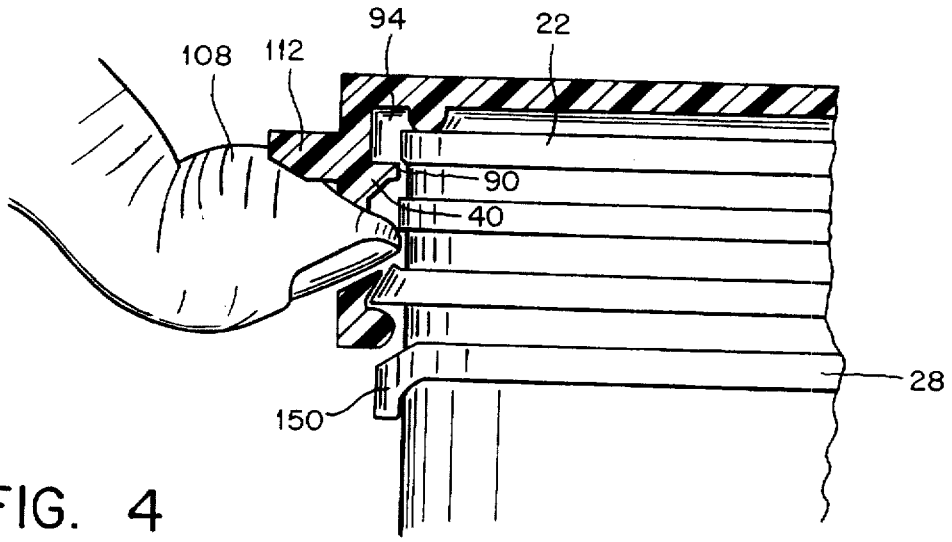
FIG. 5 is a sectional side view of the closure system shown in FIG. 1, with the cap set on the container to the predetermined position which unlocks the cap, and with a finger at the position in which the predetermined position is discovered.

Referring additionally now to FIG. 5, in order to be able to remove the cap, it must be rotated until latch finger 90 portion of anchor ridge 40 is under bypass opening 94 in retainer ridge 22. Retainer ridge 22 is preferably continuous but for latch finger bypass opening 94 which is just a little wider than the latch finger.

Anchor ridge 40 is preferably discontinuous or comprises portions of lower height so that three annular raised portions remain, a narrow one that is latch finger 90, and two small pivot arcs 96, FIG. 3, which follow out from under ridge 22 when latch finger 90 is urged up through bypass opening 94.

The three discontinuous areas 100, 102 and 104 of anchor ridge 40 permit the cap to be urged upward and off from the neck by finger 108 pressure against finger grip protrusion 112.

It is not necessary for an operator to visually examine the container to find the predetermined location for lining up the latch finger with the bypass opening. Retainer ridge 24 has a change in shape 116, preferably a discontinuity or reduction in height, that is in line with the predetermined location. This change in shape provides tactile indication of the rotational location of the bypass opening. The tactile indication is provided to the operator by contact by a finger of the operator with change 116 during rotation of the cap by the finger while the finger is simultaneously in contact with the finger grip.

Figure 6:
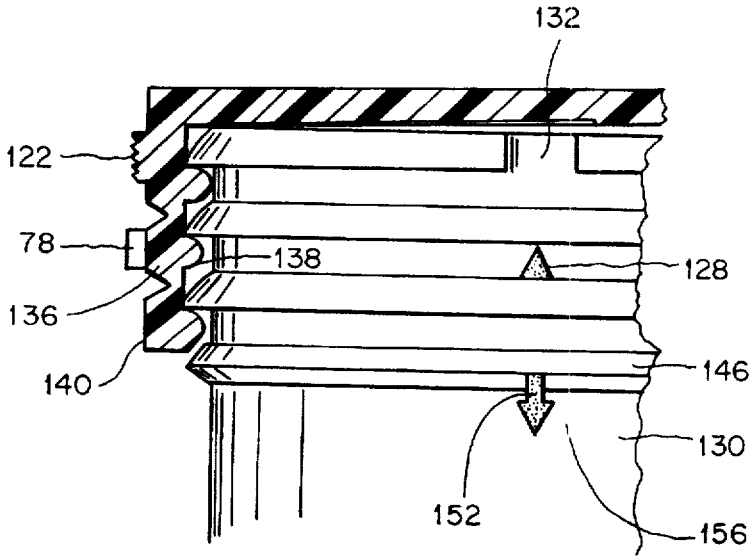
FIG. 6 is a sectional side view of a preferred embodiment of the invention.

Although finger grip 112 shown in FIG. 5 is quite large by comparison to the finger, the tactile indication works as well with just a small finger grip, for example finger grip 122 shown in FIG. 6.

Referring to FIG. 6, tear strip 136 is designed to accommodate a tactile indicator. Space is provided in the region between minor diameter surface 138 and the outer surface of neck 130 to allow for the volume of space taken up by tactile indicator 128 when tear strip 136 is in skirt 140.

Tactile indicator 128 on neck 130 provides tactile indication of the rotational location of bypass opening 132 when a finger is on finger grip 122, in the same manner as does change in shape 116 in retainer ridge 24 described above.

Tactile indicator 128 has a narrow raised arrowhead shape with a roughened surface that is easily detected by a passing finger.

Retainer ridge 28 in FIGS. 1 and 5, and retainer ridge 146 in FIG. 6 include narrow portions of change in shape with respect to the general shape of the remainder of the ridge. These narrow portions of change in shape are index keys 150 and 152 which provide a combination, visual, tactile, and assembly index means to help the operator locate the predetermined position, and to help in assembly to index the cap and container so that the cap will be located away from the predetermined position when the container with container with sealed closure system is delivered to the customer.

Index key 152 is a narrow, arrow shaped element that includes raised portions of ridge 146 and adjacent outer surface 156 of neck 130.

Figure 8:
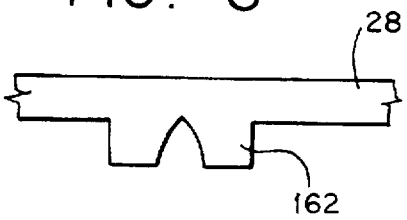
FIG. 8 is a sectional view of a tactile position indicator according to the invention.
Figure 7:
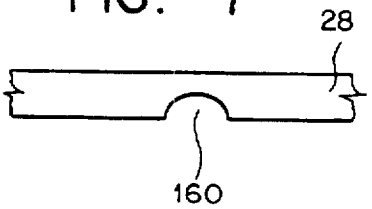
FIG. 7 is a sectional view of a tactile position indicator according to the invention.
Figure 9:
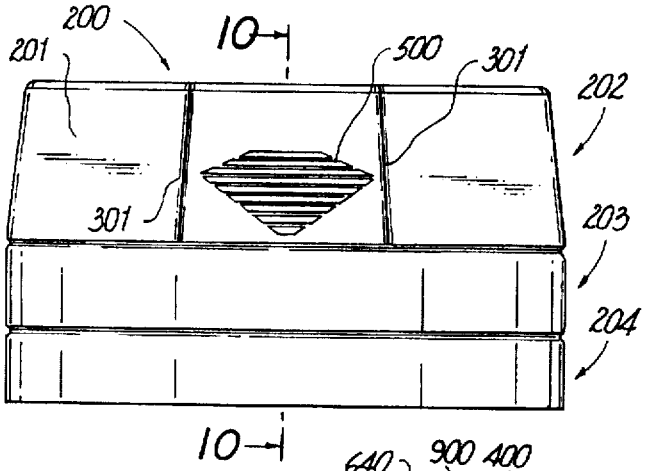
FIG. 9 is a frontal view of a child resistant, tamper-indicating closure of the invention incorporating the arthritic top.
Figure 10:
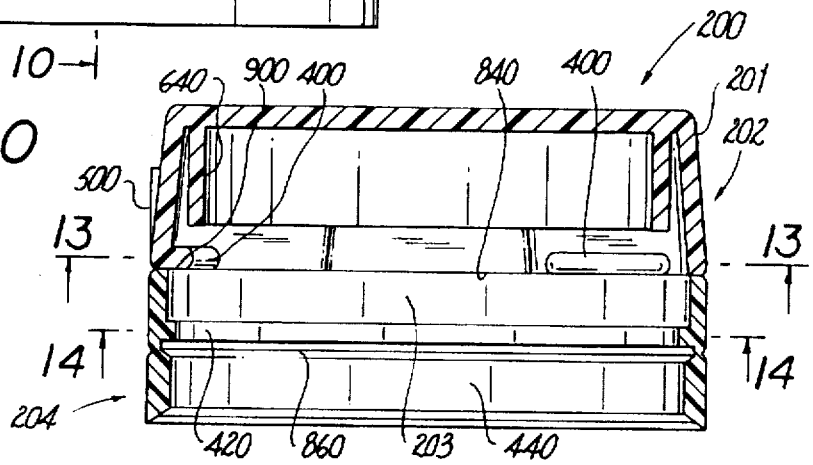
FIG. 10 is a sectional view of the closure of FIG. 9 taken along the line 10—10 of FIG. 9.
Figure 11:
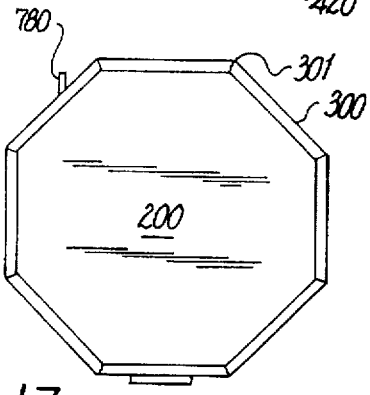
FIG. 11 is a top plan view of the closure of FIG. 9.
Figure 12:
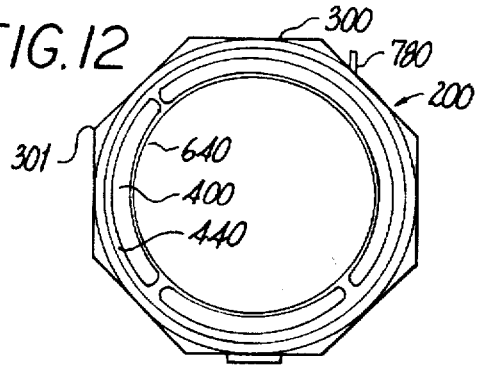
FIG. 12 is a bottom plan view of the closure of FIG. 9.
Figure 13:
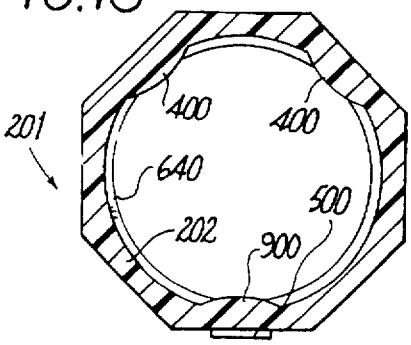
FIG. 13 is a sectional view of the closure of FIG. 9 taken along the lines 13—13 of FIG. 10.
Figure 14:
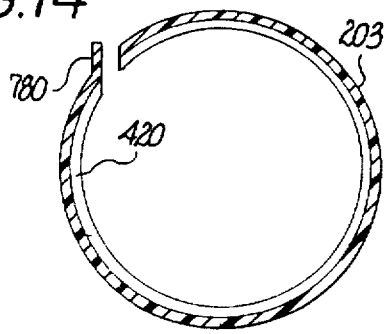
FIG. 14 is a sectional view of the closure of FIG. 9 taken along the lines 14—14 of FIG. 10.

The index key may take whatever convenient shape desired to suit its above described purpose, such as the shapes described, and index keys 160 and 162 shown in FIGS. 7 and 8 respectively.

Referring now to FIGS. 10–14, cap 200 comprises arthritic-grip-friendly top 201 with depending skirt 202, tear strip 203, and a tamper indicating ring 204, each having integrally molded therewith anchor ridges 400, 420 and 440, respectively. Annular sealing ring 640 depends from the undersurface of top 201.

It is to be noted that top 201 is longer along the axis of the cap then is the top of cap 20.

Typically, in a 38 mm (1.5") closure of the type disclosed in FIGS. 1–8, the top portion of the cap will have a height or axial length of 0.175 inch whereas in a 38 mm closure of the type disclosed in FIGS. 9–14, the axial length of the top 201 of the cap is one-half inch. The present invention includes more surface for an enfeebled hand to grasp in order to turn cap 200. When tear strip 203 has been disposed of it reveals tactile information to the user to align the latch finger 900 of anchor ridge 400 with the opening 94 in the retainer ridge 22 of the container 12 of FIGS. 1–5; or with the bypass opening 132 of the container of FIG. 6.

The outside of the top 201 of the closure is formed with a plurality of angled surfaces 300, octagonal, for example, in the cap disclosed herein, in order to provide the enfeebled hand gripping ridges 301 to further facilitate the rotation of cover 200 to align latch finger 900 with the latch finger bypass opening of the container.

Because of the added height provided by top 201 to the closure, annular sealing ring 640 also extends axially for a longer distance to contact the top of the container.

As in the first embodiment of the invention described herein, when it is desired to unseal the closure system of FIGS. 9–14, annular tear strip 203 is pulled by tab 780 to tear the strip along bands of reduced thickness 840, 860. Top 201 is rotated to align finger grip 500 with the tactile indicator or visible arrow on latch container, thus positioning the finger 900 beneath the bypass opening. The reusable cap is for reversibly sealing, that is, sealing and unsealing, the opening from which it is lifted.

Although the present invention has been described with respect to details to certain embodiments thereof, it is not intended that such details be limitations upon the scope of the invention. It will be obvious to those skilled in the art that various modifications and substitutions may be made without departing from the spirit and scope of the invention as set forth in the following claims.

We claim:

1. The combination of a container and cap, said container having a body and a neck of said body comprising an opening into said body, said cap being for reversibly sealing said opening and comprising a closure seal, a depending skirt, an annular tear strip secured to said depending skirt by a first band of reduced thickness, an annular tamper evident ring secured to said tear strip by a second band of reduced thickness, first, second and third annular raised anchor ridges extending parallel to and spaced from one another and radially inwardly successively from inner surfaces of said depending skirt, said tear strip and said ring, said neck and cap comprising a child proof lock, said closure system providing indication to a user of a first time breach of said closure seal, and comprising:

on an outer surface of said neck, in order from said opening, a first annular raised retainer ridge, a second annular raised retainer ridge generally parallel to and spaced from said first retainer ridge, and a third annular raised retainer ridge generally parallel to and spaced from said second retainer ridge, said first, second and third anchor ridges being for bearing respectively against the first, second and third retainer ridges on their distal sides with respect to said opening, when said cap is fully seated on said neck over said opening, said tear strip extending between said first and second bands, wherein removal of said tear strip frees said skirt from the remainder of said cap distal from said first band of reduced thickness so that said skirt is independent from said container when removed from said neck, means for pulling said tear strip from said skirt, said first annular raised anchor ridge being discontinuous, said inner surface and of said skirt having a single narrow latch finger in the plane of said first anchor ridge, extending generally normally from said inner surface of said skirt, a narrow portion of said first retainer ridge being of reduced height forming thereby a latch finger bypass opening through which said latch finger can pass for initiating removal of said cap from said neck, no other portion of said discontinuous first anchor ridge being narrower than said bypass opening, finger grip means for urging said cap away from said opening, and generally under said tear strip within the inclusive region from said second retainer ridge to said third retainer ridge, means for tactile indication by a finger of an operator, of the rotational location of said bypass opening by rotation of said cap while said finger is simultaneously in contact with said finger grip means, and said first, second and third retainer ridges being approximately equal in their outer diameters, said annular skirt having an axial length and a width normal to said axial length, the ratio of said width to said skirt axial length being substantially 3 to 1, a plurality of surfaces angled relative to one another about the outer side of said axial length of said annular of said annular skirt so that gripping ridges are formed between said plurality of angled surfaces, said ratio along with said plurality of angled surfaces constituting means for grasping by an enfeebled hand.

* * * * *